US011793341B2

(12) United States Patent
Olson

(10) Patent No.: US 11,793,341 B2
(45) Date of Patent: Oct. 24, 2023

(54) MAILBOX DELIVERY ALERT SYSTEM AND METHODS

(71) Applicant: Larry Eugene Olson, Ham Lake, MN (US)

(72) Inventor: Larry Eugene Olson, Ham Lake, MN (US)

( * ) Notice: Subject to any disclaimer, the term of this patent is extended or adjusted under 35 U.S.C. 154(b) by 31 days.

(21) Appl. No.: 17/683,517

(22) Filed: Mar. 1, 2022

(65) Prior Publication Data

US 2022/0304492 A1 Sep. 29, 2022

Related U.S. Application Data

(60) Provisional application No. 63/165,838, filed on Mar. 25, 2021.

(51) Int. Cl.
*A47G 29/12* (2006.01)

(52) U.S. Cl.
CPC .. *A47G 29/121* (2013.01); *A47G 2029/12105* (2017.08)

(58) Field of Classification Search
CPC ..... A47G 29/121; A47G 29/12105
See application file for complete search history.

(56) References Cited

U.S. PATENT DOCUMENTS 1,149,781 A * 8/1915 Palmer ..... A47G 29/121 232/35
1,521,397 A * 12/1924 Scott ..... A47G 29/121 232/35
1,925,227 A * 9/1933 Black ..... A47G 29/121 232/35
2,092,561 A * 9/1937 Sandifur ..... A47G 29/121 232/35
2,551,915 A 5/1951 Turner
2,687,846 A * 8/1954 Chrisman ..... A47G 29/121 232/35
2,782,983 A * 2/1957 Cyphers ..... A47G 29/121 232/35
2,797,860 A * 7/1957 Foster ..... A47G 29/121 232/35
2,852,185 A * 9/1958 Stouten ..... A47G 29/121 232/35
2,905,378 A * 9/1959 Cox ..... A47G 29/121 232/35
2,927,727 A * 3/1960 Kreider ..... A47G 29/121 232/35
3,168,239 A * 2/1965 Cooper ..... A47G 29/121 232/35
3,331,552 A 7/1967 Shultz
3,498,256 A 3/1970 Hebal
(Continued)

FOREIGN PATENT DOCUMENTS

CA 2464192 C 8/2007

*Primary Examiner* — William L Miller

(57) ABSTRACT

In a mailbox delivery alert system, a closure abutment secured to an outer end of an arm is pushed by pivoting a mailbox closure from a closed position to an open position, and the arm is moveably mounted relative to a flag intermediate its ends for movement parallel to and at non-parallel angles to the flag height. The moving arm pushes an arm abutment secured to an inner end of the arm against the flag intermediate its ends, with the arm abutment pivoting the flag from a home position to an alert position.

16 Claims, 5 Drawing Sheets

(56) References Cited

U.S. PATENT DOCUMENTS

| | | | | | |
|---|---|---|---|---|---|
| 3,623,655 | A * | 11/1971 | Tieszen | A47G 29/121 | 232/35 |
| 4,150,780 | A | 4/1979 | Mapes | | |
| 4,290,549 | A | 9/1981 | Getz, Jr. | | |
| 4,447,005 | A | 5/1984 | Kelly et al. | | |
| 4,720,042 | A * | 1/1988 | Tapy | A47G 29/121 | 232/35 |
| 4,738,392 | A | 4/1988 | Kovacs | | |
| 4,778,103 | A | 10/1988 | Nelsen | | |
| 4,836,441 | A * | 6/1989 | Crider | A47G 29/121 | 232/35 |
| 4,913,342 | A * | 4/1990 | Fluck | A47G 29/121 | 232/35 |
| 5,092,517 | A | 3/1992 | Jeffries, Jr. et al. | | |
| 5,119,986 | A | 6/1992 | Kobilarcik et al. | | |
| 5,482,206 | A * | 1/1996 | Waycasy | A47G 29/121 | 232/35 |
| 6,371,367 | B1 | 4/2002 | Otero | | |
| 7,014,097 | B1 * | 3/2006 | Gaillard | A47G 29/121 | 232/35 |
| 7,552,858 | B1 | 6/2009 | Owens | | |
| 2011/0084124 | A1 | 4/2011 | Curtis | | |
| 2011/0234402 | A1 | 9/2011 | Byrne | | |
| 2014/0346221 | A1 | 11/2014 | Pendergast | | |

* cited by examiner

MAILBOX DELIVERY ALERT SYSTEM AND METHODS

BACKGROUND

Methods and system for alerting delivery of mail to a mailbox are shown and described.

Receipt of mail may not occur each time mail is delivered by a postal worker. Additionally, the time when a postal worker makes delivery to any particular mailbox is variable. Checking if mail has been delivered can be burdensome, such as when the mailbox is a distance from where the owner of the mailbox resides or occupies, when the environment such as rain or snow creates obstacles, when the owner of the mailbox has reduced mobility such as being aged or disabled, or the like.

Thus, a need exists for methods and systems for alerting when mail has been delivered to a mailbox which are of simple construction of few components and easily added to existing mailboxes, and which are easy to operate utilizing natural occurring motions without instructions for postal workers.

SUMMARY

This need and other objectives are solved by providing methods and systems for alerting when mail has been delivered to a mailbox. Particularly, a mailbox delivery alert system is used with a mailbox including an enclosure and a closure pivotal to the enclosure about a box axis between a closed position and an open position. A flag has an axial end pivotal about a flag axis extending through the enclosure and between a home position and an alert position. The flag has a height between the axial end and a visual end. The flag axis is parallel to but spaced from the box axis. The flag in the alert position is parallel to but spaced from the closure in the closed position, with the flag in the home position being at a non-parallel angle to the closure in the closed position. A closure abutment secured to an outer end of an arm is pushed by pivoting the closure from the closed position to the open position, and the arm is moveably mounted relative to the flag intermediate the axial end and the visual end for movement parallel to the height and at non-parallel angles to the height. The moving arm pushes an arm abutment secured to an inner end of the arm against the flag intermediate the visual and axial ends, with the arm abutment pivoting the flag from the home position to the alert position.

In further aspects, the closure is pivoted from the open position to the closed position after pivoting the flag to the alert position.

In still further aspects, the flag abuts against a stop when reaching the alert position.

In additional aspects, a mount is secured to the enclosure, with the axial end pivotally mounted to the mount, and with the stop fixed to the mount.

Furthermore, in further aspects, the arm comprises first and second links in a spaced parallel relation, with the flag slideably received between the first and second links. As shown in the drawings, the first and second links are held in the spaced parallel relation by the arm abutment and the closure abutment.

Illustrative embodiments will become clearer in light of the following detailed description in connection with the drawings.

DESCRIPTION OF THE DRAWINGS

The illustrative embodiments may best be described by reference to the accompanying drawings where.

Figure 1:
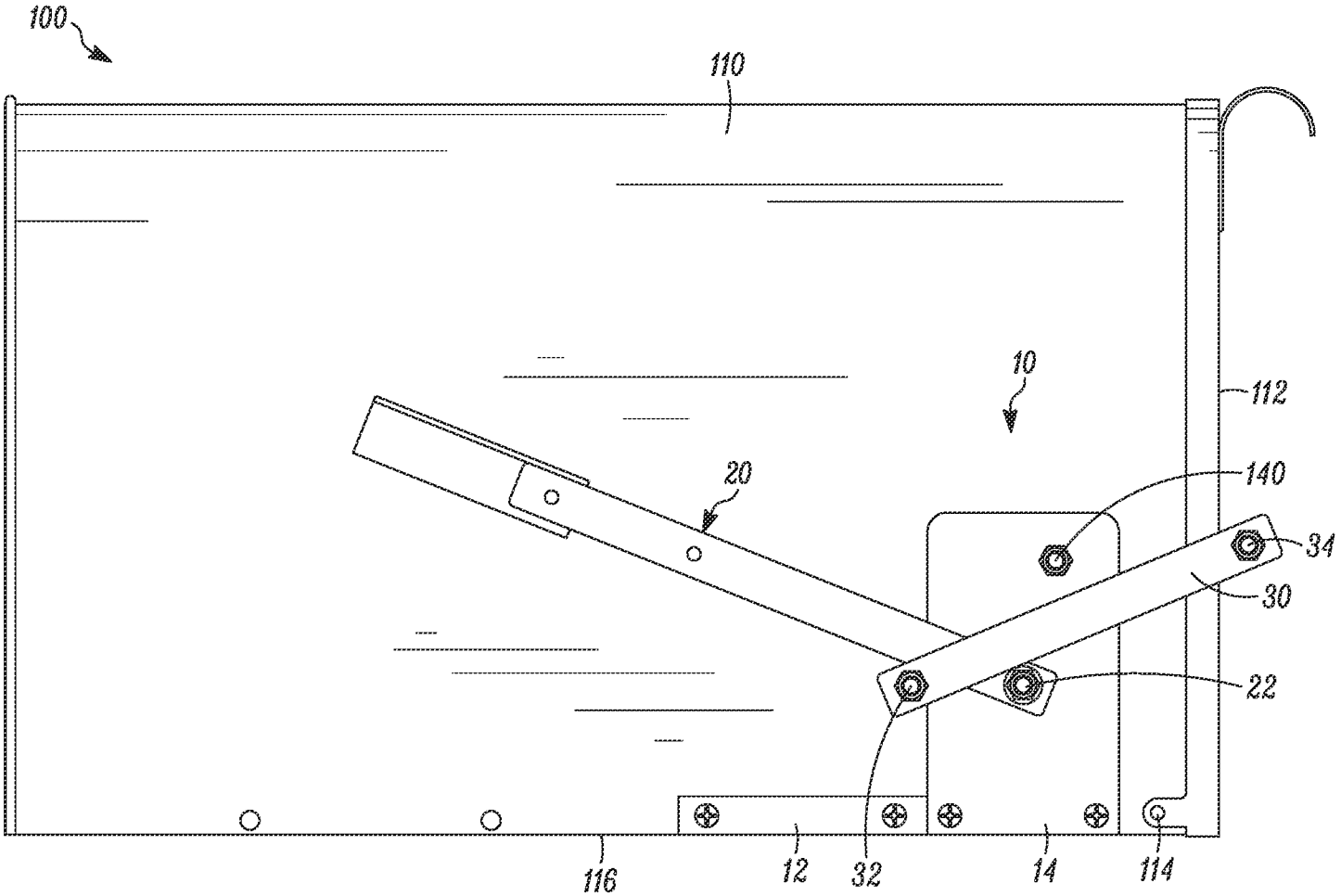
FIG. 1 shows a side view of a mailbox including a mailbox delivery alert system in a home position.

All figures are drawn for ease of explanation of the basic teachings only; the extensions of the figures with respect to number, position, relationship, and dimensions of the parts to form the illustrative embodiments will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "forward", "rearward", "reverse", "front", "back", "height", "width", "length", "end", "side", "horizontal", "vertical", and similar terms are used herein, it should be understood that these terms have reference only to the structure shown in the drawings as it would appear to a person viewing the drawings and are utilized only to facilitate describing the illustrative embodiments.

DESCRIPTION OF THE ILLUSTRATIVE EMBODIMENTS

System for alerting delivery of mail to a mailbox 100 is shown in the drawings and generally designated 10. Mailbox 100 generally includes an enclosure 110 and a closure 112 pivotally mounted to enclosure 110 about a box axis 114 between a closed position shown in FIGS. 1, 2 and 5 and an open position shown in FIG. 4.

System 10 generally includes first and second mounts 12 and 14 secured to enclosure 110 such as by screws and extending generally perpendicular to axis 114. Mount 14 abuts with mount 12 and is located intermediate mount 12 and axis 114. Mounts 12 and 14 abut with a bottom edge 116 of enclosure 110, with mount 14 having a height above bottom edge 116 a numerical multiple times greater than the height above bottom edge 116 of mount 12.

Figure 2:
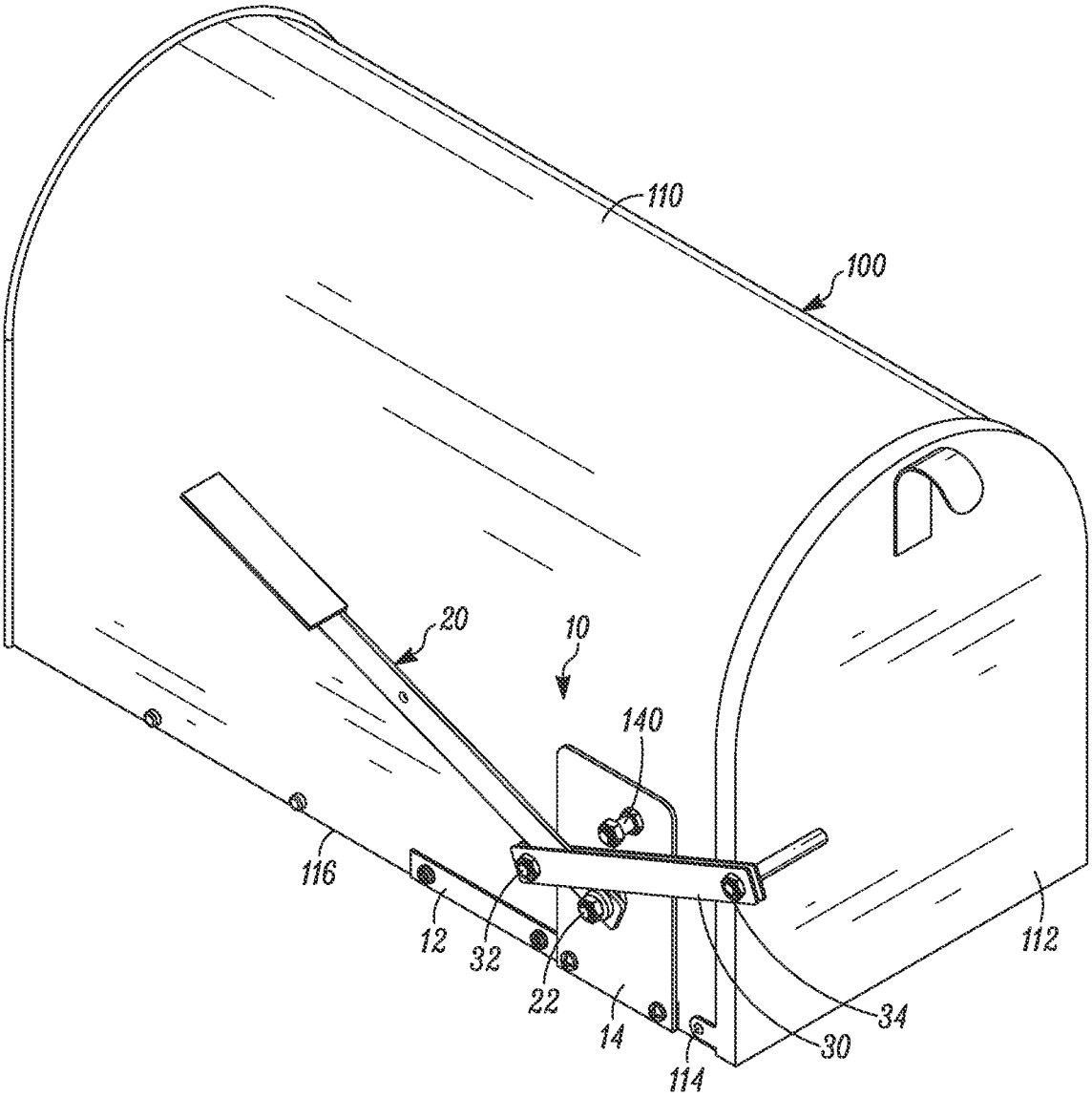
FIG. 2 shows a perspective view of the mailbox of FIG. 1.
Figure 4:
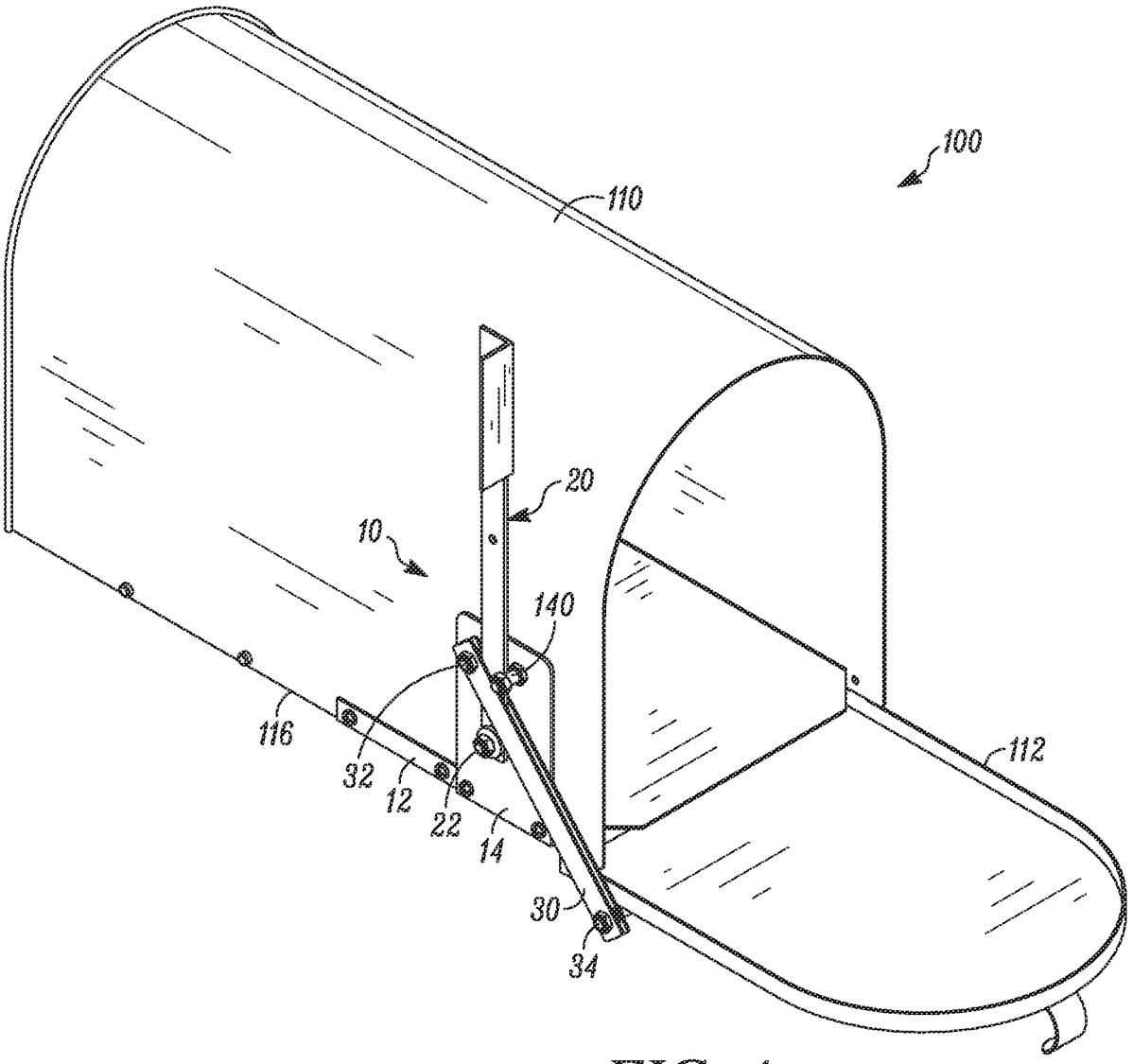
FIGS. 4 and 5 show perspective views of the mailbox of FIG. 1 in the alert open and closed positions.
Figure 5:
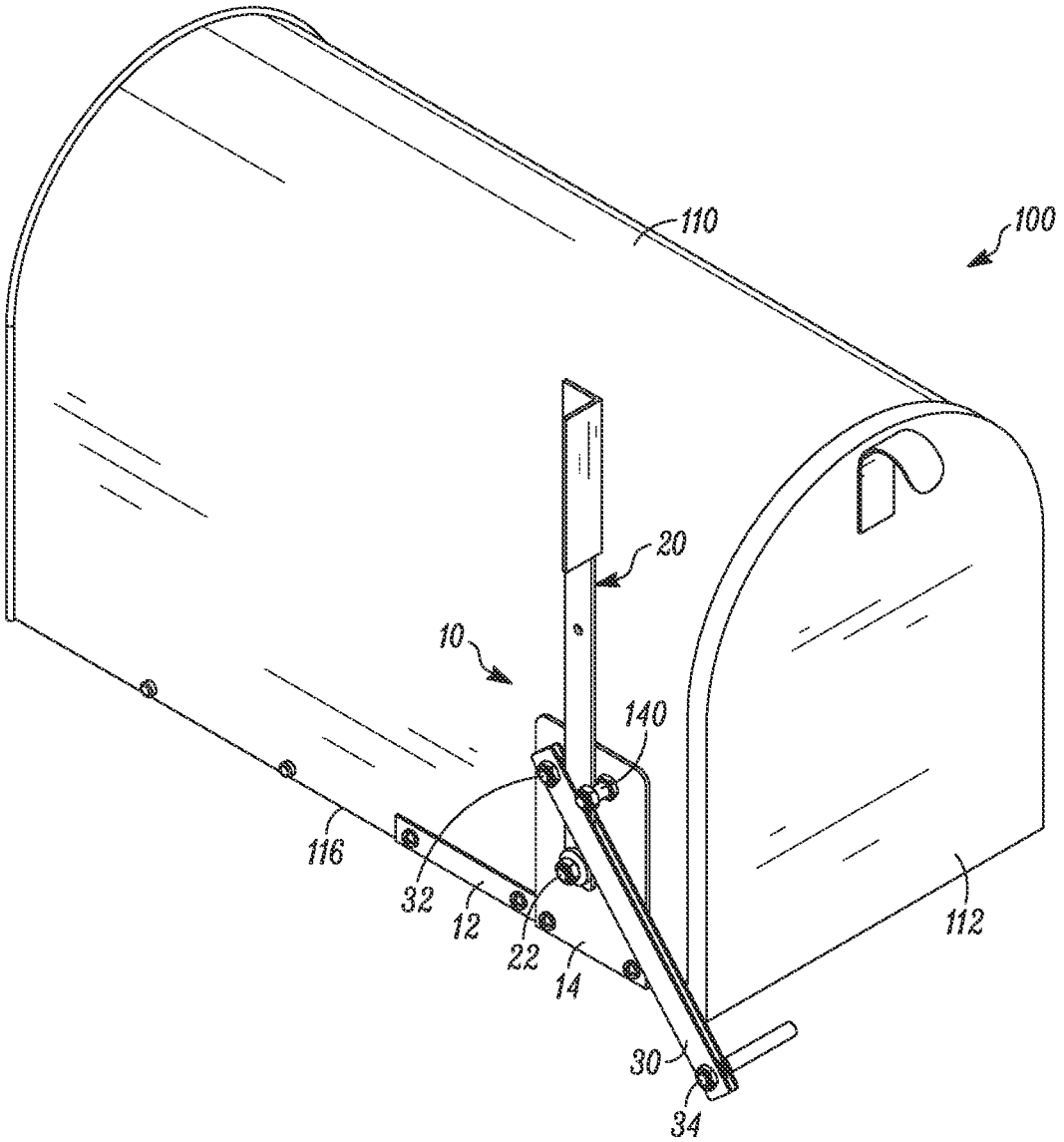

An axial end of a flag 20 is pivotably mounted to mount 14 about a flag axis 22 between a home position shown in FIGS. 1 and 2 as being at a non-parallel angle to closure 112 in the closed position and an alert position shown in FIGS. 4 and 5 as being parallel to, but spaced from, closure 112 in the closed position. Axis 22 is adapted to extend through enclosure 110 of mailbox 100 and is spaced from and parallel to axis 114, with axis 114 intermediate bottom edge 116 and axis 22 and intermediate closure 112 and axis 22. Flag 20 has a height from axis 22 between the axial end and a visual end greater than that of enclosure 110 in the alert position and has a length from axis 22 less than that of enclosure 110 in the home position. The end of flag 20 opposite to axis 22 is enlarged and can be colored or can include other visual enhancements.

An arm is formed by first and second links 30 held in a spaced parallel arrangement by first and second parallel abutments 32 and 34 at inner and outer ends of links 30. Flag 20 extends between and is slidably received between links 30 for slidable movement parallel to links 30. Abutment 32 is located at the inner end of links 30 and abuts with flag 20 intermediate its axial and visual ends. Links 30 are moveably mounted relative to flag 20 intermediate the axial and visual ends for movement parallel to the height and at non-parallel angles to the height. Axis 22 is located intermediate abutment 32 and closure 112. Closure 112 is intermediate abutment 34 and axis 22, with abutment 34 extending from the outer end of links 30 in an abutting relation with closure 112 spaced from axis 114 to act as a closure abutment.

A stop 140 is fixed to enclosure 110 by mount 14, with axis 22 located intermediate stop 140 and bottom edge 116, and with stop 140 located intermediate axes 22 and 114. Flag 20 abuts stop 140 in the alert position.

Now that the basis construction of system 10 has been set forth, a mode of operation and advantages thereof can be highlighted. In an initial position shown in FIGS. 1 and 2, closure 112 is in its closed position extending generally vertically upward from axis 114. Flag 20 is located in the home position and extends at an acute angle from axis 22 relative to bottom edge 116 away from closure 112. With flag 20 intermediate links 30, abutment 32 abuts with flag 20 opposite to closure 112 and intermediate flag 20 and bottom edge 116. Links 30 abut with axis 22 opposite to bottom edge 116. Abutment 34 is located in front of closure 112 vertically spaced above axes 22 and 114 opposite to bottom edge 116.

Figure 3:
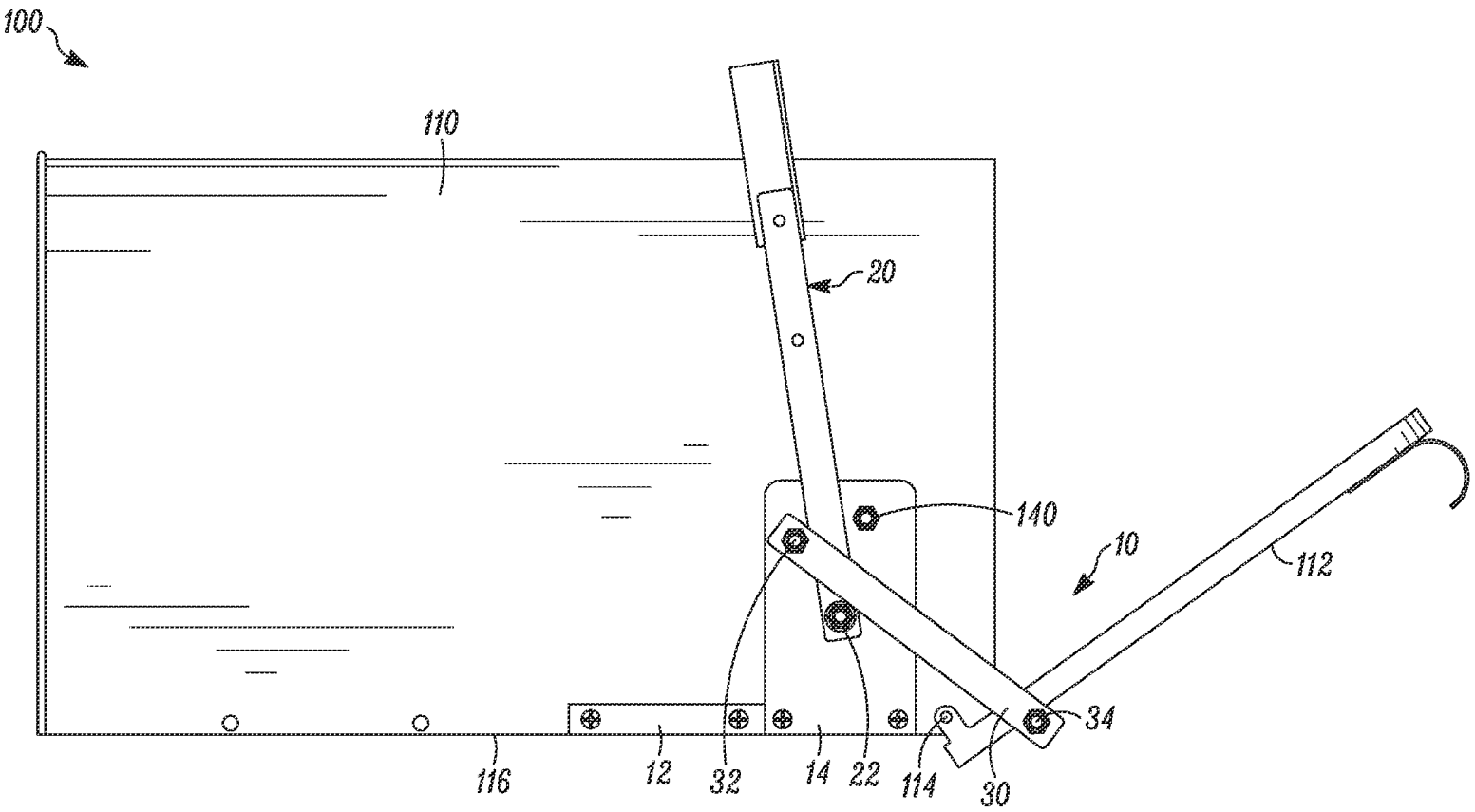
FIG. 3 shows a side view of the mailbox of FIG. 1 moving from the home position.

As a postal worker moves closure 112 from its closed position to its open position as shown in FIG. 3, closure 112 abuts abutment 34 and moves it forward away from enclosure 110 and downwardly towards bottom edge 116. The movement of abutment 34 pulls links 30 to slide and pivot on axis 22. Due to the movement of links 30, abutment 32 abuts and slides on flag 20 pushing flag 20 to pivot from its home position towards its alert position.

When closure 112 reaches its open position as shown in FIG. 4, flag 20 is in its alert position extending vertically above axis 22 opposite to bottom edge 116. Flag 20 is sandwiched between abutment 32 and stop 140. Abutment 34 is positioned below closure 112. Links 30 extend at an acute angle relative to bottom edge 116 with axis 22 located intermediate abutment 32 and bottom edge 116 and with bottom edge 116 located intermediate abutment 34 and axis 22. The postal worker then has access to enclosure 110 such as to place mail and other postal parcels into enclosure 110.

After placement of postal parcels inside enclosure 110, the postal worker can then pivot closure 112 from its open position to its closed position such as shown in FIG. 5. It should be appreciated that flag 20 remains in its alert position and that links 30 and abutments 32 and 34 remain generally in the same position as when closure 112 is in its open position of FIG. 4. The postal worker continues on his mail route and leaves the area adjacent mailbox 100.

Mailbox 100 is often positioned a distance from where the owner of mailbox 100 resides or occupies, such as at the end of a driveway. It should be appreciated that the owner of mailbox 100 is often occupied with activities and does not specifically watch mailbox 100 and/or the arrival or departure of the postal worker. However, it is not necessary for the owner of mailbox 100 to walk the distance to mailbox 100 to verify whether or not mail has been delivered into enclosure 110. Specifically, flag 20 in its alert position indicates that closure 112 has been moved from its closed position to its open position, assumedly for placement of mail parcels inside enclosure 110. Thus, the owner of mailbox 100 can move closure 112 from its closed position shown in FIG. 5 to its open position shown in FIG. 4, the mail parcels can be removed from enclosure 110, and the closure 112 can be moved from its open position shown in FIG. 4 to its closed position shown in FIG. 5. It should be appreciated that flag 20 remains in its alert position and that links 30 and abutments 32 and 34 remain generally in the same position as when closure 112 is in its open position of FIG. 4 when closure 112 is moved from its closed position to its open position and back to the closed position.

After the owner of mailbox 100 has removed the mail parcels and moved closure 112 to its closed position shown in FIG. 5, flag 20 can be pushed to pivot about axis 22 from its alert position to its home position. As flag 20 is pivoted from its alert position, flag 20 abuts with abutment 32, thereby moving links 30 from the position shown in FIGS. 4 and 5 to the position shown in FIGS. 1 and 2. Thus, mailbox 100 is in a condition to again receive mail parcels and does not indicate that access has occurred to enclosure 110.

It should be appreciated that system 10 is of a simple construction having only two moveable components. In this regard, only a slide connection exists between flag 20 and links 30 or between links 30 and closure 112, and, specifically, there is no fixed connection such as an immovable pivotal connection. System 10 can be easily added to an existing mailbox such as simply by use of screw for securing mounts 12 and 14. An alert condition is provided when the postal worker moves closure 112 from the closed position to the open position, which is the natural movement of the postal worker when placing parcels into enclosure 110, and with the postal worker not being required to manually manipulate system 10 in any way.

It should be appreciated that modification can be made to the shapes and forms of elements by persons skilled in the art. As an example, mounts 12 and 14 could be formed in different shapes, as one or more components, and even eliminated and incorporated into mailbox 100. In this regard, system 10 is shown as being utilized in a separately formed mailbox 100. However, system 10 and mailbox 100 could be formed together. As examples, flag 20 could be pivotably mounted to enclosure 110, and stop 140 could be fixed to enclosure 110, with reinforcement being optionally included in enclosure 110, flag 20, and/or stop 140 if desired. Likewise, abutment 34 could be suitably rotatably secured to closure 112 such that the outer end of links 30 is moveable with closure 112.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Mailbox delivery alert system comprising, in combination: an arm having an inner end and an outer end; an arm abutment located on the inner end and adapted to abut with a flag having a height between an axial end and a visual end, with the axial end pivotal about a flag axis adapted to extend through an enclosure of a mailbox, with the flag pivotal between a home position and an alert position, with the arm adapted to abut with the flag intermediate the axial and visual ends; a closure abutment located on the outer end and adapted to abut with a closure of the mailbox pivotal to the enclosure about a box axis spaced from and parallel to the flag axis, with the closure pivotal between a closed position and an open position, with the flag in the alert position being parallel to but spaced from the closure in the closed position, with the flag in the home position being at a non-parallel angle to the closure in the closed position, with the closure abutment adapted to abut with the closure spaced from the box axis, with the arm moveably mounted relative to the flag intermediate the axial end and the visual end for movement parallel to the height and at non-parallel angles to the height, with the closure abutment pulling the arm when the closure is pivoted from the closed position to the open position, with the arm abutment pushing the flag from the home position to the alert position, wherein the arm comprises first and second links in a spaced parallel relation, and with the flag slideably received between the first and second links.

2. The mailbox delivery alert system of claim 1 further comprising, in combination: a stop adapted to be fixed to the enclosure spaced from the flag axis and the box axis, with the flag abutting the stop in the alert position.

3. The mailbox delivery alert system of claim 2 further comprising, in combination: a mount adapted to be secured to the mailbox, with the axial end being pivotally mounted to the mount about the flag axis, and with the stop fixed to the mount.

4. The mailbox delivery alert system of claim 3 wherein the first and second links are held in the spaced parallel relation by the arm abutment and the closure abutment.

5. The mailbox delivery alert system of claim 1 wherein the first and second links are held in the spaced parallel relation by the arm abutment and the closure abutment.

6. The mailbox delivery alert system of claim 5 further comprising, in combination: a mount adapted to be secured to the mailbox, with the axial end being pivotally mounted to the mount about the flag axis.

7. The mailbox delivery alert system of claim 1 further comprising, in combination: a mount adapted to be secured to the mailbox, with the axial end being pivotally mounted to the mount about the flag axis.

8. Method comprising:

providing a mailbox including an enclosure, a closure pivotal to the enclosure about a box axis between a closed position and an open position, and a flag having an axial end pivotal about a flag axis extending through the enclosure and between a home position and an alert position, with the flag having a height between the axial end and a visual end, with the flag axis being parallel to but spaced from the box axis, with the flag in the alert position being parallel to but spaced from the closure in the closed position, with the flag in the home position being at a non-parallel angle to the closure in the closed position; and pivoting the closure from the closed position to the open position, with pivoting the closure including pushing a closure abutment secured to an outer end of an arm and moving the arm moveably mounted relative to the flag intermediate the axial end and the visual end for movement parallel to the height and at non-parallel angles to the height, with moving the arm including pushing an arm abutment secured to an inner end of the arm against the flag intermediate the visual and axial ends, with pushing the arm abutment including pivoting the flag from the home position to the alert position, wherein moving the arm comprises moving the arm comprising first and second links in a spaced parallel relation, and slideably receiving the flag between the first and second links.

9. The method of claim 8 further comprising:

pivoting the closure from the open position to the closed position after pivoting the flag to the alert position.

10. The method of claim 9 further comprising:

abutting the flag against a stop when reaching the alert position.

11. The method of claim 10 further comprising:

securing a mount to the enclosure;

pivotally mounting the axial end to the mount about the flag axis; and fixing the stop to the mount.

12. The method of claim 11 wherein moving the arm comprises holding the first and second links in the spaced parallel relation by the arm abutment and the closure abutment.

13. The method of claim 8 further comprising:

abutting the flag against a stop when reaching the alert position.

14. The method of claim 13 further comprising:

securing a mount to the enclosure;

pivotally mounting the axial end to the mount about the flag axis; and fixing the stop to the mount.

15. The method of claim 8 wherein moving the arm comprises holding the first and second links in the spaced parallel relation by the arm abutment and the closure abutment.

16. The method of claim 8 further comprising:

securing a mount to the enclosure; and pivotally mounting the axial end to the mount about the flag axis.

* * * * *